US009605863B2

(12) United States Patent
Schonhorst

(10) Patent No.: US 9,605,863 B2
(45) Date of Patent: Mar. 28, 2017

(54) SYSTEM FOR THE REGULATION OF THE INTERNAL TEMPERATURE OF A STRUCTURE

(71) Applicant: David W. Schonhorst, Gaithersburg, MD (US)

(72) Inventor: David W. Schonhorst, Gaithersburg, MD (US)

( * ) Notice: Subject to any disclaimer, the term of this patent is extended or adjusted under 35 U.S.C. 154(b) by 478 days.

(21) Appl. No.: 14/077,377

(22) Filed: Nov. 12, 2013

(65) Prior Publication Data

US 2015/0129163 A1 May 14, 2015

(51) Int. Cl.
*F24F 13/02* (2006.01)
*F24D 5/10* (2006.01)

(52) U.S. Cl.
CPC ..... *F24F 13/0227* (2013.01); *F24D 5/10* (2013.01)

(58) Field of Classification Search
CPC ..... F24D 15/00; F24D 5/10; F24F 13/0227
USPC ..... 165/49, 52
See application file for complete search history.

(56) References Cited

U.S. PATENT DOCUMENTS 2,559,868 A * 7/1951 Gay ..... E04B 1/0023 165/45
2,559,869 A * 7/1951 Gay ..... E04B 1/0023 126/632
2,559,871 A * 7/1951 Gay ..... E04B 1/0023 126/630
2,561,290 A * 7/1951 Payant ..... F24D 5/10 237/53
3,262,493 A * 7/1966 Hervey ..... F24D 11/003 126/620
3,299,795 A * 1/1967 Teixeira ..... F24F 5/0089 454/185
3,688,983 A * 9/1972 Erickson ..... F24D 5/10 237/50
3,929,186 A * 12/1975 Becker ..... E04B 1/803 165/49
3,989,098 A * 11/1976 Takasaki ..... F24F 7/04 165/48.1
4,000,850 A * 1/1977 Diggs ..... F24D 3/005 126/613
4,006,856 A * 2/1977 Nilsson ..... F24D 5/10 126/591
4,054,246 A * 10/1977 Johnson ..... F24D 11/007 126/400
4,076,013 A * 2/1978 Bette ..... F24D 11/007 126/400
RE29,924 E * 3/1979 Becker ..... E04B 1/7092 165/49

(Continued)

*Primary Examiner* — Devon Russell
(74) *Attorney, Agent, or Firm* — Michael L. Greenberg, Esq.; Greenberg & Lieberman, LLC

(57) ABSTRACT

A system for regulating the internal temperature of a structure such as a domicile or office is described. The system is configured to employ a series of inter-wall channels, designed to direct air originating from at least one HVAC unit and at least one heat exchanger in order to equalize the temperature within the walls, ceiling, and the flooring of a conventional structure. In this manner, the system employs air as an effective insulator, supplementing the existing fiberglass insulation of a structure with a dynamic, temperature sensitive means of insulation, helping to keep heating and cooling costs down, and limiting strain on the HVAC units of the structure.

4 Claims, 3 Drawing Sheets

(56) References Cited

U.S. PATENT DOCUMENTS 4,227,566 A * 10/1980 Stilber ..... F24D 11/007 126/629
4,285,332 A * 8/1981 McHugh ..... F24D 3/005 126/609
4,295,415 A * 10/1981 Schneider, Jr. ..... E04B 1/7612 126/620
4,296,798 A * 10/1981 Schramm ..... E04B 1/74 126/629
4,408,596 A * 10/1983 Worf ..... F24D 11/00 126/630
4,462,334 A * 7/1984 Kim ..... A01K 31/00 119/436
4,523,519 A * 6/1985 Johnson ..... F24D 11/006 165/45
4,580,487 A * 4/1986 Sosnowski ..... F24F 5/0075 126/400
4,741,391 A * 5/1988 Schmitz ..... F24F 12/00 165/56
5,217,000 A * 6/1993 Pierce-Bjorklund ..... E04B 1/74 126/621
5,826,650 A * 10/1998 Keller ..... F24D 11/0257 126/620
6,220,339 B1 * 4/2001 Krecke ..... F24D 11/003 126/585
6,843,718 B2 * 1/2005 Schmitz ..... F24F 5/0075 454/186
7,028,685 B1 * 4/2006 Krecke ..... E04B 1/74 126/620
7,222,801 B2 * 5/2007 Meirana ..... F24D 3/12 165/49
8,306,667 B2 11/2012 Baba et al.
8,322,092 B2 * 12/2012 Isaacs ..... F24D 3/005 165/10
8,595,998 B2 * 12/2013 Isaacs ..... F24J 3/082 165/10
2008/0216441 A1 * 9/2008 Hamlin ..... F24D 5/10 52/741.1
2013/0168041 A1 * 7/2013 Teron ..... E04B 5/48 165/49

* cited by examiner

SYSTEM FOR THE REGULATION OF THE INTERNAL TEMPERATURE OF A STRUCTURE

FIELD OF THE PRESENT INVENTION

The present invention relates to methods of temperature control, and more specifically, methods capable of regulating the temperature of an enclosed open space or living area, by controlling the temperature of the air surrounding this enclosed space. The temperature of the surrounding air is controlled by circulating conditioned air through small air channels surrounding the walls, ceiling, and floor of the open space.

BACKGROUND OF THE PRESENT INVENTION

During the process of home construction, many components are erected or assembled into place in order to ensure a secure and relatively air-tight structure. For example, a foundation is poured, an optional basement is placed, and wooden framing is erected to form the basis for walls, electrical conduits, insulation, and mounting points for roof framing. Conventionally, these frames are held together with conventional nails, bolts, and various other components that are equipped to bind the frames together. Commonly, insulation is placed into the cavities formed between the framing and the surfaces employed to cover and finalize the walls and ceilings. This insulation is conventionally composed of fiberglass, a urethane, or similar lightweight components.

Unfortunately, insulation that is conventionally employed in the construction of a structure is often not enough to adequately minimize heat loss within the structure. As a result of inadequate insulation, the HVAC unit of the house often has to work harder to overcome the change in heat brought about via undesired air circulation from air escaping the house. While no land structure is preferably completely air-tight, the insulation employed by construction workers in the construction of the structure is designed to minimize any exchange of heat between the outside air and the indoor air.

While it is known that air, or rather the gaseous mix that comprises what people breathe and refer to as 'air,' is an exceptional insulator, few have managed to employ it properly within a confined space in order to ensure it acts as a proper insulator. Notable exceptions include double paned windows, which employ an air tight cavity to hold air within the two panes of glass, helping to insulate the window. Fiberglass is a relatively effective means of insulation in part because it is fibrous, and has many places where air may penetrate or be held within the foam or fiberglass fibers. However, the air held within and between the fibers of fiberglass is subject to air circulation, and is eventually exchanged from air from the outdoors, limiting the efficacy of the insulation. As a result, the air held within the framing of the house within the insulation is rarely the approximate temperature of the interior of the structure. Similarly, foam insulation is a highly effective form of insulation, however it would be more effective if the air exposed to the insulation was regulated, and kept at a relatively consistent temperature.

Thus there is a need for a way to employ conditioned, isolated air within the walls, ceilings, and even the basement as an effective means of insulation, helping to keep heating and cooling costs low, and minimizing the strain on the HVAC unit of the structure.

U.S. Pat. No. 8,306,667B2, published on Nov. 6, 2012, filed by Baba and the Mitsubishi Electric Corporation is for an Air-Conditioning Apparatus. While Baba has a similar configuration of HVAC units to that of the present invention, the present invention differs in that it employs a series of channels within the walls, ceilings, and flooring of the structure.

SUMMARY OF THE PRESENT INVENTION

The present invention is a system configured to be installed within a structure and is designed to augment the conventional HVAC system of the structure by circulating conditioned air within specially designed channels created within the walls, ceiling, and floors, helping to maintain a consistent temperature, and to ensure effective insulation of the structure. The present invention employs a series of channels which are designed to direct air in a specific fashion inside a cavity erected within a structure. This air preferably originates from at least one HVAC unit that is conventionally designed to direct air into a series of ducts within the structure. Two HVAC's are positioned ⅓ from each end of the structure—preferably one HVAC upstairs near the attic and one HVAC downstairs near the basement or ground floor. In short, the present invention is designed to replace the conventional Heating and Cooling system for temperature control. The fan and ductwork of the conventional air handling system without the heating and cooling units may be retained for air circulation purposes.

It is envisioned that the HVAC units employed by the present invention are preferably small, given that the volume of air that is treated by the HVAC units is relatively small—only the spaces established within the channels of the present invention. In contrast to conventional construction, which relies on conditioning (heating/cooling) all of the air within an enclosed structure or living space which requires large furnaces and cooling devices, the present invention conditions only the small amount of air in the small air passages which surround the open space. Further, current construction relies on heating and cooling (conditioning) of the structure by conditioning the air in the open space or living area. This requires the furnace or A/C to condition a very large volume of air to achieve and maintain the desired temperature. The present invention does not require a large HVAC system to function properly.

The channels are preferably rectangular in shape, and are formed by a series of spacing planks placed directly over structural interior wall studs and surfacing material, ceiling surfacing and flooring. They are preferably formed by 1×2 (or other similarly sized) planks arranged in parallel, which vertically line the walls, and connect to matching planks installed in the ceiling and flooring of the structure. A second piece of drywall or other surfacing material is placed over the planks, creating the cavity between the planks, the first piece of drywall (the original wall), and the second piece of drywall, forming the channels. The channels are configured to literally encircle the house, so that they traverse the exterior walls of the dwelling, as well as the ceiling (below the attic), and the flooring.

The channels are designed to alternatingly receive air from a specified HVAC unit that the channel is routed to. Ideally, the air flowing within each sequential channel alternates in its origin—for example, a first channel carries air from the first HVAC unit, the second channel carries air from the second HVAC unit, the third channel carries air originating from the first HVAC unit and the fourth channel carries air from the second HVAC unit. Given that the first HVAC unit is preferably placed on the opposite side of the structure as the second HVAC unit, the air flowing within the channels also alternate in direction of air flow.

Likewise, the channels can carry air from opposite HVAC's so that, for example, in the winter, hot air would come from the first HVAC on one side the house for a first channel, but then the second channel next to the first channel would have hot air that has come from a second HVAC from the other side of the house. (In this way, the temperature of air is more uniform throughout the channels as channel 1 might have hotter air, adjacent channel 2 might have not as hot air, adjacent channel 3 would have air slightly cooler than channel 1, but hotter than channel 2, as channel 2 has air that has traveled from the second HVAC on the opposite side of the house.

It is envisioned that the present invention employs at least one heat exchanger which is preferably integrated into the HVAC unit per convention. Similarly, it is envisioned that, in the preferred embodiment of the present invention, two HVAC units could work in tandem to expedite the equalization of the temperature of the air within the cavities. It is the intent of the present invention to ensure that a uniform, desired temperature remains consistent within each channel. The channels comprising the cavities are preferably vertical channels that are installed just beneath a piece of drywall or other surfacing material. The drywall may be the original wall if the system of the present invention is installed at the time of the construction of the structure, however in the preferred embodiment of the present invention, the original drywall of the house is superimposed with a second piece of drywall.

The present invention relates to methods of thermal insulation, and more specifically, methods capable of regulating the temperature of a structure via an enhanced insulation technique, configured to employ circulated air as an insulator within the walls, ceilings, and floors of the structure.

DETAILED DESCRIPTION OF THE PREFERRED EMBODIMENT

Figure 1:
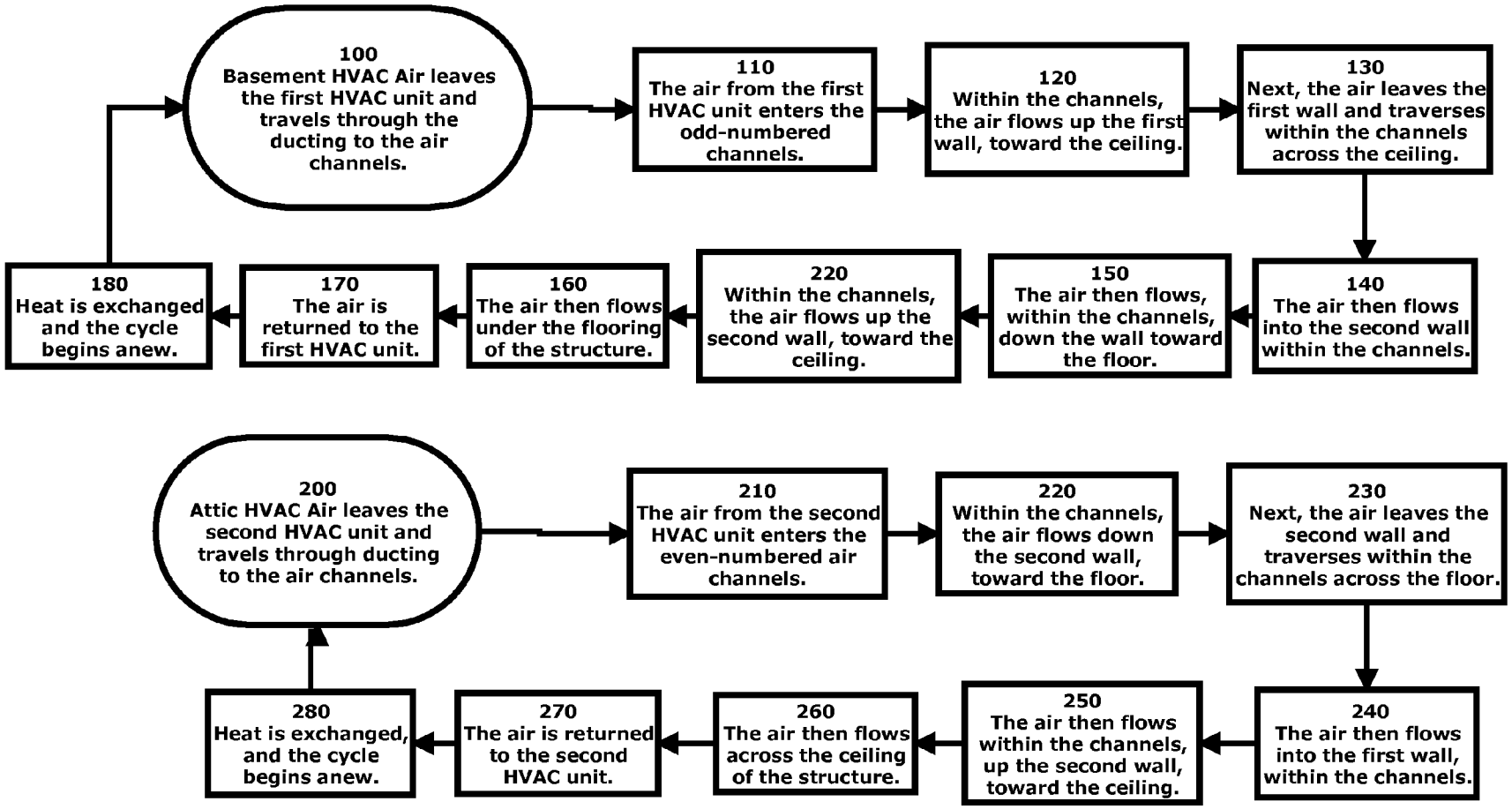
FIG. 1 shows a flow chart detailing the process of the preferred embodiment of the present invention as it relates to the flow or path of air.
Figure 2:
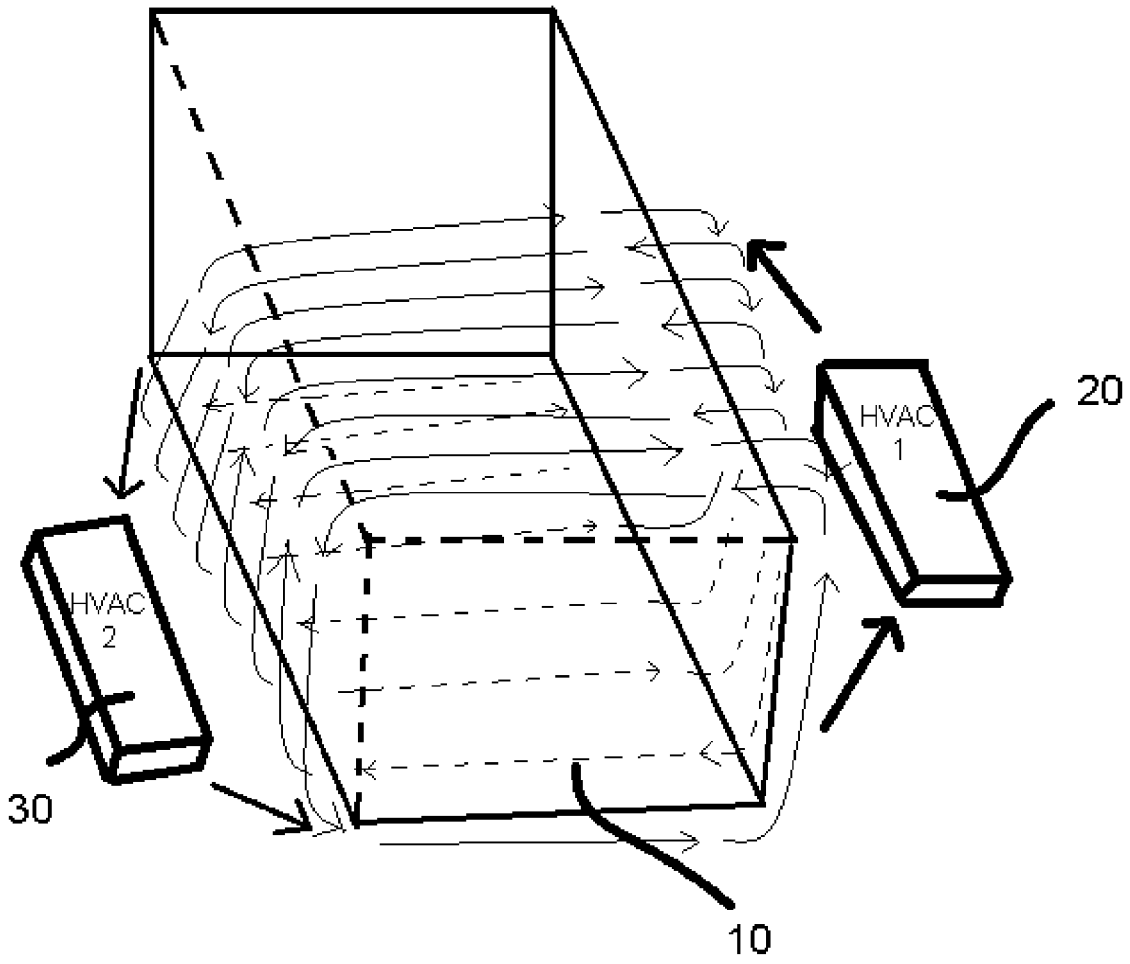
FIG. 2 depicts an outline of the components and path of air of the present invention while in use.
Figure 3:
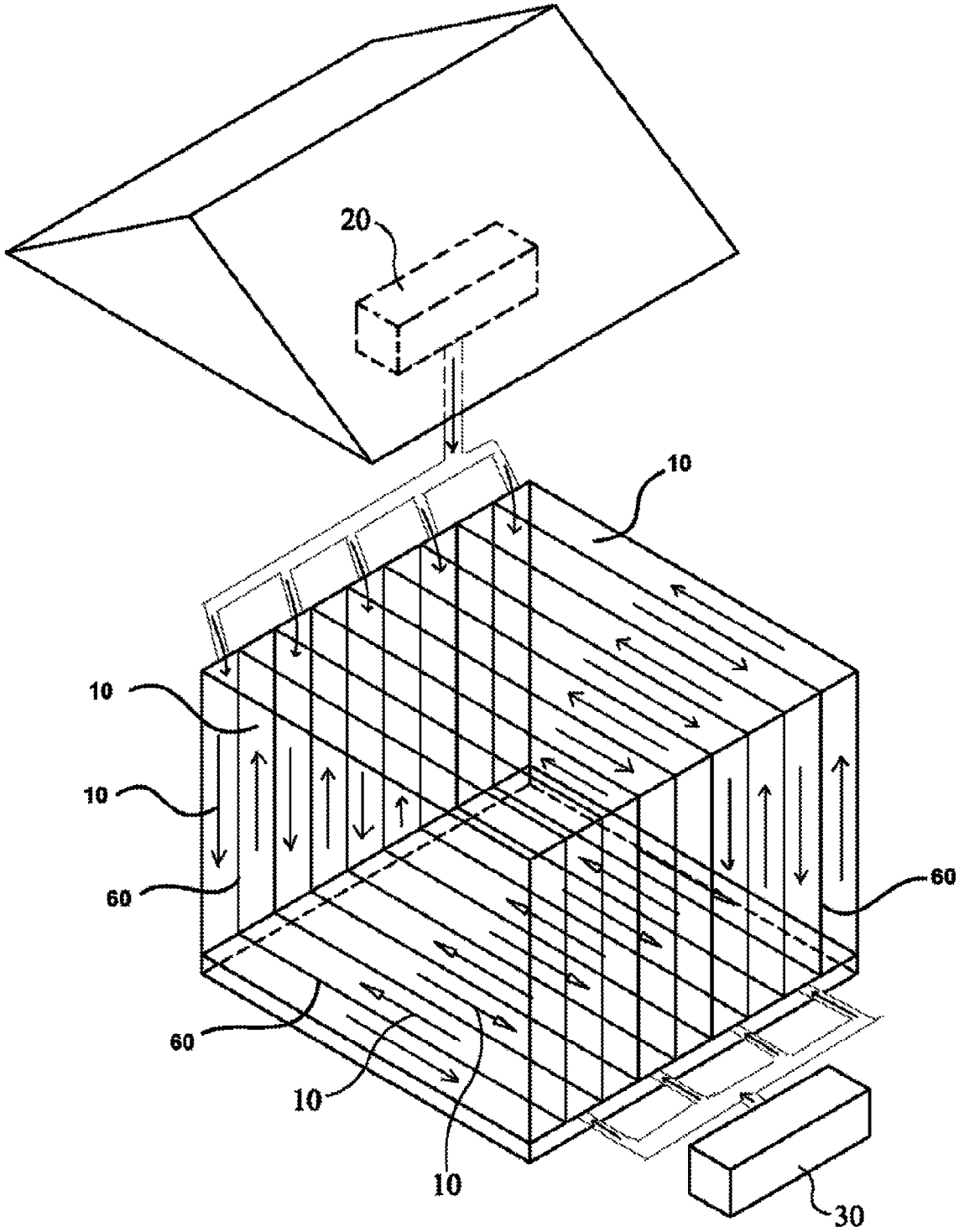
FIG. 3 is a diagram exhibiting the preferred placement of HVAC units and the routing of water heater exhaust to the system of the present invention.

The present invention is a system designed to aide in the regulation of the temperature of a house or similar structure. The overall intent of the system of the present invention regarding temperature regulation is to provide an effective means of further insulating a structure. The preferred embodiment of the present invention primarily consists of a series of channels (10), a first HVAC unit (20), a second HVAC unit (30), and in some embodiments, ducting (40). The present invention may also employ additional sheets of drywall (50), otherwise known as sheetrock, although wood or other surfacing materials may be employed rather than conventional sheetrock. In order for the system of the present invention to function, the series of channels (10) must be implemented into the walls, ceiling, and flooring of the structure.

The channels (10) of the present invention are preferably constructed on the inside of the structure by affixing a series of spacing planks (60) (with the approximate dimensions of 1"×2") to the interior drywall of the structure, including the drywall lining the walls, and ceiling of the structure. The channels (10) are preferably arranged in linear lines, providing for there to be both even and odd numbered channels when referred to sequentially. Additionally, the channels are incorporated underneath the flooring of the structure as well, forming complete channels that link together at the junction of the walls, floor, and ceiling. The spacing planks (60) are then covered by a second piece of drywall (70), completing the rectangular channels and causing them to remain relatively air tight. The spacing planks (60) are preferably aligned with the wooden studs beneath the first piece of drywall. The studs of the framework will provide a solid and secure surface. The ceiling and flooring surfaces are ideally the exterior ceiling and floors, rather than interior ceilings and floors. The spacing planks (60) could be similar to wooden 1×2's, which are approximately ¾"×1½" or even thinner or even wider for that matter if necessary to facilitate the adequate flow of conditioned air. Plywood or other materials may be used rather than drywall to create a subfloor with the channels (10) between the floor and the subfloor. Ceilings and floors between levels within the house are preferably not equipped with these channels (10).

It should be understood that the four walls that compose the channels (10) include the first piece of drywall (the original interior wall of the structure), the spacing planks (60), and the second piece of drywall (70). When the channels enter the ceiling of the structure, the channels (10) are preferably routed either above the original ceiling drywall, into the attic, or the channels (10) may be installed under new ceiling drywall, similar to the manner in which the channels (10) are established within the walls.

The first HVAC unit (20) is preferably placed as far from the second HVAC unit (30) as possible in order to aide in the equalization of the temperature of the air within the channels. Therefore, if the structure has multiple levels, the first HVAC unit (20) may be placed outside of the ceiling or attic while the second HVAC unit (30) is preferably placed on an opposite side of the structure, downstairs. Both the first HVAC unit (20) and the second HVAC unit (30) are envisioned to be relatively small HVAC units, in order to maintain low energy costs, and because such little conditioning is required for such a small volume of air. Additionally, the present invention may employ the heat lost from a conventional house-hold water heater to augment the system.

The preferred path of air flow through the odd-numbered channels of the present invention is as follows: Air in a first channel leaves the first HVAC unit (20) and begins to travel up a first wall. Next, the air leaves the first wall and traverses across the ceiling. Then, the air passes through a second HVAC unit (20) and is redirected to channels (10) that are opposite or adjacent to the prior channels (10). Next, the air flows down a second wall. Subsequently, the air then flows underneath the flooring of the structure, and back to the first HVAC unit (20). This path is reversed for air originating from the second HVAC unit (30), which is routed to the even-numbered channels of the present invention initially, and then is recycled through the first HVAC unit (20), and then routed back to the second HVAC unit (10) through the odd-numbered channels.

It should be noted that the nature of the channels (10) requires that they have junctions at the ends or corners of the structure. It is envisioned that a plenum exists that runs down the middle of the ceiling or attic portion of the channels (10), as well as on the lowest level or basement channels (10), which will preferably 'T-off' in the shape of a T. The T shape of the channel (10) will run the distance from the midline of the drywall to the sides of the structure. It is at the end of the structure that the cold air return and the warm air supply will be accessible for maintenance and installation of the present invention.

Alternate embodiments of the present invention include the use of the exhaust from a conventional house-hold water heater. While the present invention does not directly employ the air originating from the exhaust from the water-heater, it is envisioned that a heat exchanger (80) could be employed to transfer the heat from the water-heater exhaust to the air being circulated through the channels (10) within the structure. In this embodiment, strain on the first HVAC unit (20) and the second HVAC unit (30) are further diminished, as less energy is lost to wasted heat. This embodiment is more applicable in the winter, when the user ideally wishes to have warmer temperatures indoors.

Similarly, in other embodiments of the present invention, the system of the present invention may employ a total of two heat exchangers to work in tandem and conjunction with the first HVAC unit (20) and the second HVAC unit (30) in order to effectively equalize the air within the channels (10), and expedite the effective insulation of the structure.

The overall intent of the system of the present invention regarding temperature regulation is to provide an effective means of heating or cooling a structure while also, reducing the energy consumed. It is envisioned that, in alternate embodiments of the present invention, additional HVAC units can be added as necessary depending on the size, shape, and insulation of the structure. The additional HVAC units are preferably spaced at adequate distances from one another in order to maximize the efficacy of the HVAC units. Conditioned air from the first HVAC unit (20) could be channeled around the structure and back to the return side of the first HVAC unit (20), and likewise, the conditioned air from the second HVAC unit (30) would then be channeled around the structure in alternate channels (10) to the return side of the second HVAC unit (30).

Alternatively, conditioned air from the first HVAC unit (20) could be channeled around the structure and back to the 'return' side of the second HVAC unit (30), and the conditioned air from the second HVAC unit (30) is channeled around the structure and back to the 'return' side of the first HVAC unit (20). It should be noted that the channels (10) employed by variations of the present invention may be configured to travel up one side of the structure and then down the other side of the structure, or conversely, they could alternate laterally or horizontally like the stripes of a zebra.

Referring to FIG. 1, the preferred path of air flow provided by the system of the present invention can clearly be seen. First, the Basement HVAC air leaves the first HVAC unit and travels through ducting to the air channels. (100) Next, the air from the first HVAC unit enters the odd numbered air channels. (110) Within the odd numbered air channels, the air flows up the first wall, toward the ceiling. (120) Next, the air leaves the first wall and traverses within the odd numbered air channels across the ceiling. (130) The air then flows into the second wall within the odd numbered air channels. (140) The air then flows within the odd numbered air channels, down the second wall toward the floor. (150) The air then flows underneath the flooring of the structure. (160) The air is returned to the first HVAC unit. (170) Heat is exchanged and the cycle begins anew. (180) Simultaneously, Attic HVAC Air leaves the second HVAC unit and travels through ducting to the air channels. (200) The air from the second HVAC unit enters the even numbered air channels. (210) Within the channels, the air flows down the second wall towards the floor. (220) Next, the air leaves the second wall and traverses within the even numbered channels across the floor. (230) The air then flows into the first wall within three even numbered channels. (240) Subsequently, the air then flows within the even numbered channels up the second wall toward the ceiling. (250) The air then flows across the ceiling of the structure. (260) The air is returned to the second HVAC unit. (270) Finally, Heat is exchanged, and the cycle begins anew (280).

Having illustrated the present invention, it should be understood that various adjustments and versions might be implemented without venturing away from the essence of the present invention. Further, it should be understood that the present invention is not solely limited to the invention as described in the embodiments above, but further comprises any and all embodiments within the scope of this application.

I claim:

1. A system for regulation of temperature in a structure, comprising:

a first series of channels disposed between an interior wall and an exterior wall, continuing into a ceiling and a floor of the structure, said first series of channels configured to direct temperate air;

a second series of channels disposed alternatingly adjacent to said first series of channels, said second series of channels configured to direct temperate air;

wherein said interior wall and said exterior wall are separated by a spacing planks;

wherein said spacing planks serve as dividers between each channel of said first series of channels and each channel of said second series of channels;

a first heating, ventilating, and air conditioning unit in communication with said first series of channels;

a second heating, ventilating, and air conditioning unit in communication with said second series of channels;

wherein each channel of said first series of channels and said second series of channels completely circumscribes a livable human environment of the structure;

wherein each channel of said first series of channels follow the following path within the structure:

across a floor of the structure, up a first wall of the structure, across a ceiling of the structure, down a second wall of the structure, and returning to the first wall of the structure;

wherein each channel of said second series of channels follows the following path within the structure:

up the second wall of the structure, across the ceiling of the structure, down the first wall of the structure, across the floor of the structure, and returning to the second wall of the structure;

wherein air contained within said first series of channels does not mix with air contained within said second series of channels; and wherein said first series of channels and said second series of channels are configured to prevent air within said series of channels from entering said livable human environment of the structure.

2. The system of claim 1, wherein said first heating, ventilating, and air conditioning unit is positioned centrally in the structure.

3. The system of claim 1, further comprising said first heating, ventilating, and air conditioning unit positioned in an attic of the structure.

4. The system of claim 1, further comprising:

wherein said first heating, ventilating, and air conditioning unit is disposed in an attic of the structure; and said second heating, ventilating, and air conditioning unit positioned outside of a lowest floor of the structure.

* * * * *